US010675861B2

(12) United States Patent
Kilde et al.

(10) Patent No.: US 10,675,861 B2
(45) Date of Patent: Jun. 9, 2020

(54) METHOD AND APPARATUS FOR PRINTING CYLINDRICAL STRUCTURES

(71) Applicants: REXAM BEVERAGE CAN EUROPE LIMITED, Luton Bedfordshire (GB); REXAM BEVERAGE CAN SOUTH AMERICA S.A., Rio de Janeiro (BR)

(72) Inventors: Henrik Kilde, Fredericia (DK); Michael Bo Hansen, Fredericia (DK); Bruno Leonardo Giublin, São José dos Campos (BR); Leandro Augusto Guilherme, São José dos Campos (BR)

(73) Assignee: BALL BEVERAGE PACKAGING EUROPE LIMITED, Loton, Bedfordshire (GB)

( * ) Notice: Subject to any disclaimer, the term of this patent is extended or adjusted under 35 U.S.C. 154(b) by 0 days.

(21) Appl. No.: 15/532,625

(22) PCT Filed: Dec. 4, 2015

(86) PCT No.: PCT/GB2015/053725
§ 371 (c)(1),
(2) Date: Jun. 2, 2017

(87) PCT Pub. No.: WO2016/087876
PCT Pub. Date: Jun. 9, 2016

(65) Prior Publication Data

US 2018/0009217 A1 Jan. 11, 2018

(30) Foreign Application Priority Data

Dec. 4, 2014 (EP) ..... 14196388

(51) Int. Cl.
*B41F 17/22* (2006.01)
*B41F 33/00* (2006.01)
(Continued)

(52) U.S. Cl.
CPC ..... *B41F 33/0081* (2013.01); *B41F 13/14* (2013.01); *B41F 17/22* (2013.01);
(Continued)

(58) Field of Classification Search
CPC ..... B41F 17/22; G01N 21/8851; G01N 21/9036; G01N 21/9045; B21D 51/2692; B21D 51/2646
(Continued)

(56) References Cited

U.S. PATENT DOCUMENTS 3,098,564 A 7/1963 Fouse et al.
3,252,410 A 5/1966 Stephenson
(Continued)

FOREIGN PATENT DOCUMENTS

CA 2097619 5/1992
CH 654524 A5 2/1986
(Continued)

OTHER PUBLICATIONS

Written Opinion and Search Report for PCT/GB2015/053725 dated Feb. 25, 2016 (9 pages).
(Continued)

*Primary Examiner* — Leslie J Evanisko
(74) *Attorney, Agent, or Firm* — Greer, Burns & Crain, Ltd.

(57) ABSTRACT

According to the invention there is an apparatus for printing onto cylindrical structures comprising: a plurality of inker devices each comprising a print cylinder and one or more servomotors for adjustably controlling the position or orientation of a print cylinder; a blanket device comprising a plurality of print blankets, in which the blanket device is configured to bring each print blanket into contact with the print cylinders to transfer ink from the print cylinders to the print blanket, and to bring each print blanket into contact
(Continued)

with a cylindrical structure to achieve printing thereon; a transporter for transporting the cylindrical structures into and out of contact with the print blankets; and an automatic print correction system comprising a print inspection device for detecting a misregistration of ink transferred from one or more of the print cylinders onto a print blanket, and a controller for controlling the servomotors of the print cylinders to correct the misregistration in response to data received from the print inspection device.

15 Claims, 4 Drawing Sheets

(51) Int. Cl.
*B41F 13/14* (2006.01)
*B41F 27/00* (2006.01)
*B41M 1/40* (2006.01)
*B41M 1/06* (2006.01)

(52) U.S. Cl.
CPC ..... *B41F 27/00* (2013.01); *B41M 1/06* (2013.01); *B41M 1/40* (2013.01)

(58) Field of Classification Search
USPC ..... 101/38.1, 39, 40
See application file for complete search history.

(56) References Cited

U.S. PATENT DOCUMENTS 3,262,460 A 7/1966 Huddle et al.
3,286,302 A 11/1966 Doering
3,313,409 A 4/1967 Johson
3,357,950 A 12/1967 La Follett
3,504,390 A 4/1970 Wing
3,752,073 A 8/1973 Lorber
3,766,851 A 10/1973 Sirvet et al.
3,782,542 A 1/1974 Scribner
3,923,158 A 12/1975 Fornna
3,952,698 A 4/1976 Beyer et al.
3,960,073 A 6/1976 Rush
3,983,729 A 10/1976 Traczyk et al.
3,991,673 A 11/1976 Coale et al.
4,048,917 A 9/1977 Skrypek et al.
4,105,122 A 8/1978 Flood et al.
4,132,826 A 1/1979 Dessauer et al.
4,142,462 A 3/1979 Gilore
4,319,930 A 3/1982 Yano et al.
4,327,756 A 5/1982 Rath
4,374,681 A 2/1983 Schueneman
4,378,493 A 3/1983 Dorf et al.
4,384,518 A 5/1983 Albin
4,395,946 A 8/1983 Price
4,399,357 A 8/1983 Dorf et al.
4,442,934 A 4/1984 Dorf et al.
4,471,011 A 9/1984 Sporing
4,479,429 A 10/1984 Haryu
4,492,476 A 1/1985 Miyazawa
4,519,232 A 5/1985 Traczyk et al.
4,519,310 A 5/1985 Shimizu et al.
4,589,339 A 5/1986 Fischer
4,616,306 A 10/1986 Kuzma et al.
4,620,090 A 10/1986 Ducloux
4,732,027 A 3/1988 Traczyk et al.
4,741,266 A 5/1988 Stirbis et al.
4,774,839 A 10/1988 Caleffi et al.
4,790,662 A 12/1988 Bischkopf et al.
4,872,024 A 10/1989 Nagai et al.
4,884,504 A 12/1989 Sillars
4,889,560 A 12/1989 Jaeger et al.
4,898,752 A 2/1990 Cavagna et al.
4,903,599 A 2/1990 Kulber et al.
4,924,083 A 5/1990 Ishikawa et al.
4,924,107 A 5/1990 Tucker
5,010,814 A 4/1991 Shishikura
5,017,795 A 5/1991 Dower et al.
5,049,432 A 9/1991 Ooms et al.
5,065,905 A 11/1991 Eddy et al.
5,120,126 A 6/1992 Wertz et al.
5,181,471 A 1/1993 Sillars
5,213,043 A 5/1993 Reimers et al.
5,235,911 A 8/1993 Dorfman et al.
5,282,306 A 2/1994 Katsuhiro
5,335,682 A 8/1994 Yoshimura et al.
5,337,659 A 8/1994 Whelan
5,339,731 A 8/1994 Howard et al.
5,351,617 A 8/1994 Williams et al.
5,353,703 A 10/1994 Rieker
5,356,481 A 10/1994 Yoshimura et al.
5,385,092 A 1/1995 Lewis et al.
5,469,787 A 11/1995 Turner et al.
5,497,900 A 3/1996 Caleffi et al.
5,502,476 A 3/1996 Neal et al.
5,591,255 A 1/1997 Small et al.
5,591,462 A 1/1997 Darling et al.
5,713,288 A 2/1998 Frazzitta
5,771,798 A 6/1998 Shriver
5,806,427 A 9/1998 Niemiro et al.
5,908,505 A 6/1999 Bargenquest et al.
5,919,839 A 7/1999 Titterington et al.
5,970,865 A 10/1999 Horth et al.
5,974,974 A 11/1999 Agnew et al.
5,987,161 A 11/1999 Dowane et al.
6,037,101 A 3/2000 Telser et al.
6,058,839 A 5/2000 Frazzitta
6,079,326 A 6/2000 Strutz et al.
6,139,779 A 10/2000 Small et al.
6,174,937 B1 1/2001 Banning et al.
6,184,988 B1 2/2001 Ferrari
6,196,675 B1 3/2001 Deily et al.
6,238,837 B1 5/2001 Fan
6,309,453 B1 10/2001 Banning et al.
6,312,872 B1 11/2001 Murphy
6,395,123 B1 5/2002 Fromson et al.
6,473,169 B1 10/2002 Dawley et al.
6,494,950 B1 12/2002 Fujita et al.
6,494,961 B2 12/2002 Simpson
6,525,333 B1 2/2003 Ishikawa et al.
6,543,350 B2 4/2003 Gilliam et al.
6,550,389 B1 4/2003 Goto et al.
6,551,422 B1 4/2003 O'Connor
6,553,907 B2 4/2003 Richards
6,584,845 B1 7/2003 Dawley et al.
6,594,927 B2 7/2003 Witkowski
6,640,713 B2 11/2003 Landsman
6,651,559 B2 11/2003 Haraux et al.
6,755,202 B1 6/2004 Scholey et al.
6,779,445 B2 8/2004 Schaede
6,779,455 B2 8/2004 Figov et al.
6,827,019 B1 12/2004 Strauch et al.
6,899,998 B2 5/2005 Figov
6,920,822 B2 7/2005 Finan
6,989,226 B2 1/2006 Hieronymus et al.
7,227,166 B2 6/2007 Araki et al.
7,308,142 B2 12/2007 Cochran et al.
7,309,563 B2 12/2007 Paul et al.
7,313,270 B2 12/2007 Sones et al.
7,394,937 B2 7/2008 Sones
7,399,526 B2 7/2008 Sones
7,464,642 B2 12/2008 Schaede
7,488,965 B2 2/2009 Dalmais et al.
7,667,836 B2 2/2010 Cochran et al.
7,684,034 B2 3/2010 Sones et al.
7,691,549 B1 4/2010 Glasser
7,773,214 B2 8/2010 Sones et al.
7,810,922 B2 10/2010 Gervasi et al.
7,821,629 B2 10/2010 Sones et al.
7,997,199 B2 8/2011 Watanabe et al.
RE42,715 E 9/2011 Sones et al.
8,014,586 B2 9/2011 Akkerman et al.
8,034,207 B2 10/2011 Hunahata
8,409,698 B2 4/2013 Byers et al.

(56) References Cited

U.S. PATENT DOCUMENTS

| | | | | |
|---|---|---|---|---|
| 8,544,385 | B2 | 10/2013 | Schuler-Cossette et al. | |
| 8,574,492 | B2 | 11/2013 | Morita et al. | |
| 9,409,433 | B2 | 8/2016 | Carreras | |
| 9,475,276 | B2 | 10/2016 | Fleischer et al. | |
| 9,555,616 | B2 | 1/2017 | Carreras et al. | |
| 2002/0083855 | A1 | 4/2002 | Samworth | |
| 2002/0148485 | A1 | 10/2002 | Taft et al. | |
| 2002/0178945 | A1 | 12/2002 | Richards | |
| 2002/0189471 | A1 | 12/2002 | Juffinger et al. | |
| 2003/0015105 | A1 | 1/2003 | Dewig | |
| 2003/0024554 | A1 | 2/2003 | Schultz et al. | |
| 2003/0056410 | A1 | 3/2003 | Witkowski | |
| 2003/0089261 | A1 | 5/2003 | Landsman | |
| 2003/0101885 | A1 | 6/2003 | Jordan | |
| 2003/0150346 | A1 | 8/2003 | Haraux et al. | |
| 2003/0179920 | A1 | 9/2003 | Hooker et al. | |
| 2004/0011234 | A1 | 1/2004 | Figov et al. | |
| 2004/0126682 | A1 | 7/2004 | Dreher et al. | |
| 2004/0173110 | A1 | 9/2004 | Roesch | |
| 2004/0191693 | A1 | 9/2004 | Takamiya | |
| 2004/0211446 | A1 | 10/2004 | Schultz et al. | |
| 2005/0098051 | A1 | 5/2005 | Flint et al. | |
| 2006/0019196 | A1 | 1/2006 | Miyoshi | |
| 2006/0121389 | A1 | 6/2006 | Anzures et al. | |
| 2006/0137548 | A1 | 6/2006 | Vetter | |
| 2007/0084368 | A1 | 4/2007 | Vest et al. | |
| 2007/0289905 | A1 | 12/2007 | Sondag | |
| 2008/0002182 | A1 | 1/2008 | Akkerman et al. | |
| 2009/0106958 | A1 | 4/2009 | Lanz et al. | |
| 2009/0303307 | A1 | 12/2009 | Yasumatsu | |
| 2010/0031834 | A1 | 2/2010 | Morgavi et al. | |
| 2010/0229737 | A1 | 9/2010 | Ouchi | |
| 2010/0295885 | A1 | 11/2010 | LaCaze | |
| 2010/0319555 | A1 | 12/2010 | Hashimoto et al. | |
| 2011/0079158 | A1 | 4/2011 | Recchia et al. | |
| 2011/0104615 | A1 | 5/2011 | Sievers | |
| 2011/0126760 | A1 | 6/2011 | Daems et al. | |
| 2011/0140010 | A1 | 6/2011 | Akkerman et al. | |
| 2011/0162542 | A1 | 7/2011 | Nakamura et al. | |
| 2011/0197923 | A1 | 8/2011 | Battaglioli et al. | |
| 2011/0255134 | A1 | 10/2011 | Shigeta et al. | |
| 2011/0283905 | A1 | 11/2011 | Sakata | |
| 2012/0048135 | A1 | 3/2012 | Burberry et al. | |
| 2012/0103216 | A1 | 5/2012 | Knisel et al. | |
| 2012/0204746 | A1 | 8/2012 | Fullgraf | |
| 2012/0216689 | A1 | 8/2012 | Cochran et al. | |
| 2012/0238675 | A1 | 9/2012 | Kataura et al. | |
| 2012/0274695 | A1 | 11/2012 | LaCaze et al. | |
| 2012/0315412 | A1 | 12/2012 | Clayton et al. | |
| 2013/0019566 | A1 | 1/2013 | Schach | |
| 2013/0075675 | A1 | 3/2013 | Krutak et al. | |
| 2013/0087059 | A1* | 4/2013 | Baird | B41F 33/0027 101/416.1 |
| 2013/0105743 | A1 | 5/2013 | Owen et al. | |
| 2013/0176358 | A1 | 7/2013 | Yamada et al. | |
| 2013/0208105 | A1 | 8/2013 | Schmidt et al. | |
| 2013/0228086 | A1 | 9/2013 | Baldwin et al. | |
| 2013/0231242 | A1 | 9/2013 | Clayton et al. | |
| 2013/0242276 | A1 | 9/2013 | Schadebrodt et al. | |
| 2013/0340885 | A1 | 12/2013 | Clayton et al. | |
| 2014/0039091 | A1 | 2/2014 | Owen et al. | |
| 2014/0072442 | A1 | 3/2014 | Bowman et al. | |
| 2014/0187668 | A1 | 7/2014 | Owen et al. | |
| 2014/0210201 | A1 | 7/2014 | Owen et al. | |
| 2014/0212654 | A1 | 7/2014 | Clayton et al. | |
| 2014/0253718 | A1 | 9/2014 | Leitzen et al. | |
| 2014/0272161 | A1 | 9/2014 | Clayton et al. | |
| 2015/0035970 | A1 | 2/2015 | Brumbaugh et al. | |
| 2015/0138295 | A1 | 5/2015 | Lindner et al. | |
| 2015/0174891 | A1 | 6/2015 | Boas et al. | |
| 2015/0183211 | A1 | 7/2015 | Petti et al. | |
| 2015/0290923 | A1 | 10/2015 | Treloar | |
| 2016/0001546 | A1 | 1/2016 | Hughes et al. | |
| 2016/0129687 | A1 | 5/2016 | Boas et al. | |
| 2016/0229198 | A1* | 8/2016 | Izume | B41F 33/0045 |
| 2016/0347048 | A1 | 12/2016 | Carreras | |
| 2017/0013452 | A1 | 4/2017 | Boas et al. | |
| 2017/0157964 | A1 | 6/2017 | Izume | |
| 2017/0334659 | A1 | 11/2017 | Leitzen et al. | |
| 2018/0009216 | A1 | 1/2018 | Egerton et al. | |
| 2018/0009217 | A1 | 1/2018 | Henrik | |
| 2018/0024076 | A1* | 1/2018 | Efner | G01N 21/8851 101/40.1 |
| 2018/0086128 | A1 | 3/2018 | Hughes et al. | |
| 2018/0201011 | A1* | 7/2018 | Efner | B41F 33/0045 |

FOREIGN PATENT DOCUMENTS

| | | | |
|---|---|---|---|
| CN | 101808825 | | 8/2010 |
| CN | 102143846 | | 8/2011 |
| CN | 103109233 | | 5/2013 |
| DE | 202004007783 | | 9/2005 |
| DE | 102006025897 | | 1/2007 |
| EP | 202928 | | 11/1986 |
| EP | 317987 | | 5/1989 |
| EP | 545862 | | 6/1993 |
| EP | 0646148 | | 3/1995 |
| EP | 0717320 | | 6/1996 |
| EP | 1162064 | A2 | 12/2001 |
| EP | 1262316 | | 12/2002 |
| EP | 1630600 | | 3/2006 |
| EP | 2153991 | | 2/2010 |
| EP | 2196314 | | 6/2010 |
| EP | 2317387 | | 5/2011 |
| EP | 2384890 | | 11/2011 |
| EP | 2842747 | | 3/2015 |
| EP | 3050705 | A1 | 8/2016 |
| GB | 1298205 | | 11/1972 |
| GB | 2097331 | | 11/1982 |
| GB | 2512678 | | 10/2014 |
| JP | S58-49256 | | 3/1983 |
| JP | H09-210924 | | 8/1997 |
| JP | H9-295396 | | 11/1997 |
| JP | H09-295396 | | 11/1997 |
| JP | 2000-121580 | | 4/2000 |
| JP | 2000-258899 | | 9/2000 |
| JP | 2001/030612 | | 2/2001 |
| JP | 2002-156338 | | 5/2002 |
| JP | 2003-019457 | | 1/2003 |
| JP | 2007/076209 | | 3/2007 |
| JP | 2008-249668 | | 10/2008 |
| JP | 2010-249541 | | 11/2010 |
| JP | 2013-508196 | | 3/2013 |
| KR | 10-2006-0004679 | | 1/2006 |
| WO | 1990/02044 | | 3/1990 |
| WO | 94/07693 | | 4/1994 |
| WO | 96/41299 | | 12/1996 |
| WO | 98/17474 | | 4/1998 |
| WO | 98/41966 | | 9/1998 |
| WO | 00/27644 | | 5/2000 |
| WO | 0112440 | A1 | 2/2001 |
| WO | 2004069539 | | 8/2004 |
| WO | 2005/023545 | | 3/2005 |
| WO | 2005047011 | | 5/2005 |
| WO | 2006/048022 | | 5/2006 |
| WO | 2008092940 | A2 | 8/2008 |
| WO | 2009/090389 | | 7/2009 |
| WO | 2012/054655 | | 4/2012 |
| WO | 2012148576 | | 11/2012 |
| WO | 2013/028804 | | 2/2013 |
| WO | 2013/115800 | | 8/2013 |
| WO | 2013113616 | | 8/2013 |
| WO | 2013/155423 | | 10/2013 |
| WO | 2014/008544 | | 1/2014 |
| WO | 2014006517 | | 1/2014 |
| WO | 2014/096088 | | 6/2014 |
| WO | 2014108489 | | 7/2014 |
| WO | 2014128200 | | 8/2014 |
| WO | 2014/144853 | | 9/2014 |
| WO | 2014/164796 | | 10/2014 |
| WO | 2014/199469 | | 12/2014 |
| WO | 2014/201005 | | 12/2014 |
| WO | 2015/046119 | | 4/2015 |
| WO | 2015101828 | | 7/2015 |

(56) References Cited

FOREIGN PATENT DOCUMENTS

| | | | |
|---|---|---|---|
| WO | 2016/183452 | | 11/2016 |
| WO | 2018013465 | A1 | 1/2018 |
| WO | 2018/057739 | | 3/2018 |

OTHER PUBLICATIONS

"Blanket for Offset Printing," Offset printing technology, 2016, 4 pages [retrieved from: www.offsetprintingtechnology.com.sub-categories/blanket-for-offset-printing/].
Bowell et al., "Advancing Flexography: The Technical Path Forward," DuPont, 2011, retrieved from www2.dupont.com/packaging_graphics/en_us/assets/downloads/pdf/advflexo_brochure.pdf, 12 pages.
"Chemical Milling," Wikipedia, Feb. 13, 2015, retrieved from http://en.wikipedia.org/wiki/chemical_milling, 6 pages.
"Cyrel® DSP High Performance Plate," DuPont, 2016, 2 pages [retrieved online from: www.dupont.com/products-and-services/printing-package-printing/flexographic-platemaking-systems/brands/cyrel/products/sub-products/cyrel-dsp.html].
Corrected Notice of Allowance for U.S. Appl. No. 14/686,517, dated Sep. 28, 2016 6 pages.
"Dry Offset Printing," Encyclopedia Britannica, 2016, 2 pages [retrieved online from: www.britannica.com/technology/dry-offset].
"DuPont™ Cyrel®: CyrelTM Digital flex plate Imagers (CDI)" DuPont, 2009, retrieved from http://www2.dupont.com/packaging_graphics/en_gb/assets/downloads/pdf/CDI_family_english.pdf, 8 pages.
"DuPont™ Cyrel® DPR: Robust Digital Plate for Highest Quality Printing," DuPont 2010, retrieved from http://www2.dupont.com/packaging_graphics/en_us/assets/downloads/pdf/DP_Cyrel_DS_DPR_us_low.pdf., 2 pages.
"DuPont™ Cyrel® NOWS: Rugged, High-Performance Analog Plate," DuPont, 2007, retrieved from http:www2.dupont.com/packaging_graphics/en_us/assests/downloads/pdf/Cyrel_NOWS.pdf, 2 pages.
"EPDM Rubber," Wikipedia, Oct. 24, 2014, retrieved from http://enwikipedia.org/wiki/EPDM_rubber, 3 pages.
Extended Search Report for European Patent Application No. 14810948.1, dated Apr. 11, 2017 10 pages.
"Flexographic Ink," Wikipedia, Sep. 18, 2014, retrieved from http://en.wikipedia.org/wiki/flexographic_ink, 2 pages.
"Flexography," Wikipedia, Dec. 15, 2014, retrieved from http://en.wikipedia.org/wiki/flexographic, 6 pages.
International Preliminary Report on Patentability for International (PCT) Patent Application No. PCT/US2014/041713, dated Dec. 15, 2015 6 pages.
International Preliminary Report on Patentability for International (PCT) Patent Application No. PCT/US2016/027576, dated Jul. 22, 2016 6 pages.
International Search Report and Written Opinion for International (PCT) Patent Application No. PCT/US16/27576, dated Jul. 22, 2016 5 pages.
International Search Report and Written Opinion for International (PCT) Patent Application No. PCT/US14/41713, dated Oct. 10, 2014 8 pages.
"Laser Engraving," Wikipedia, Jan. 16, 2015, retrieved from http://en.wikipedia.org/wiki/laser_engraving, 10 pages.
"Luminous Paint," Wikipedia, Jul. 7, 2014, retrieved from http://en.wikipedia.org/wiki/luminous_paint, 4 pages.
Mine, "How Offset Printing Works," retrieved on Feb. 9, 2015 from www.howstuffworks.com/offset-printing.htm/printable, 5 pages.
Notice of Allowance for U.S. Appl. No. 14/301,018, dated Apr. 6, 2016 10 pages.
Notice of Allowance for U.S. Appl. No. 15/231,128, dated Jan. 5, 2018 8 pages.
Notice of Allowance for U.S. Appl. No. 14/686,517, dated Sep. 13, 2016 9 pages.
Official Action for U.S. Appl. No. 14/301,018, dated Aug. 14, 2015 10 pages.
Official Action for U.S. Appl. No. 14/005,873, dated Aug. 26, 2015, 27 pages.
Official Action for U.S. Appl. No. 14/301,018, dated Dec. 15, 2015 8 pages.
Official Action for U.S. Appl. No. 14/686,517, dated Jan. 15, 2016 8 pages.
Official Action for U.S. Appl. No. 15/231,128, dated Jul. 13, 2017 8 pages.
Official Action for U.S. Appl. No. 14/686,517, dated Jul. 6, 2016 9 pages.
Official Action for U.S. Appl. No. 14/301,018, dated May 13, 2015 5 pages.
Official Action for U.S. Appl. No. 14/686,517, dated Oct. 15, 2015 5 pages Restriction Requirement.
"Offset Lithography," PrintWiki, retrieved Feb. 9, 2015 from http://printwiki.org/offset_lithography, 8 pages.
Office Action for corresponding Japanese Patent Application No. 2017-530183 and Translation (6 pages).
"Offset Printing," Wikipedia, Dec. 11, 2014, retrieved from http://en.wikipedia.org/wiki/offset_printing, 12 pages.
"Offset Printing," Offset Printing Technology, 2016, 4 pages [retrieved online from: www.offsetprintingtechnology.com].
"Offset Printing," BusinessDictionary.com, 2015, 2 pages [retrieved online from: www.businessdictionary.com/definition/offset-printing.html].
"Offset Printing/Dry Offset," Buse Printing & Packaging, 2016, 1 page [retrieved online from: buseprinting.com/offset_printing.html].
"Plate," PrintWiki, retrieved Feb. 9, 2015 from http://printwiki.org/Plate, 6 pages.
"Printmaking," Wikipedia, Feb. 12, 2015, retrieved from http://en.wikipedia.org/wiki/printmaking, 14 pages.
Third Party Observations for European Patent Application No. 14810948.1, dated Jan. 29, 2018 5 pages.
Third Party Observations for European Patent Application No. 14810948.1, dated Dec. 21, 2016 5 pages.
"What is Offset Printing (Offset Lithography)?" TechTarget, 2016, 13 pages [retrieved online from: whatis.techtarget.com/definition/offset-printing-offset-lithography].
Examination Search Report for corresponding Canadian Patent Application No. 2,968,923 dated Mar. 15, 2018 (3 pages).
Stolle Machinery Company, "Concord 36MRT Decorator, Operating and Maintenance Manual," Centennial, CO, 133 pages.

* cited by examiner

300

METHOD AND APPARATUS FOR PRINTING CYLINDRICAL STRUCTURES

TECHNICAL FIELD

This invention relates to apparatus for printing onto cylindrical structures and to associated methods of printing onto cylindrical structures.

BACKGROUND

In the field of industrial can manufacture, it is typical that the finished product requires some form of decoration in the form of printed indicia. Specialist printing machines are known to provide continuous, mass printing onto cans at a high throughput. These printing machines are commonly known as "decorators" in the art. At the present time, there are two main decorator designs which are in common commercial use, although there are additional, smaller volume manufacturers as well. The two main designs are commonly known as the "Concord" and "Rutherford" machines. Although the precise constructional details of the Concord and Rutherford machines differ, in essence they use the same approach to printing onto cans. This approach is a variant of offset printing. More specifically, the decorators comprise a plurality of inkers. Each inker is associated with a different colour, and has a printing plate for that colour. Each inker is configured to distribute ink of the correct colour onto the printing plate. The printing plate has a raised portion corresponding to the desired image for the particular colour in question. It will be apparent that, for example, a six inker decorator machine can print six colours, and an eight inker decorating machine can print eight colours. The ink from the print plate of each inker is transferred onto the surface of one of a number of blankets. The intention is that the blanket and the print cylinders of all of the inkers are mutually positioned and oriented such that the different coloured inks are in proper registration. When proper registration is achieved, the pattern of multiply coloured inks on the blanket corresponds to the desired indicia. The decorator machines comprise a plurality of blankets which are disposed on a rotating blanket wheel. As the wheel rotates, a blanket which has had all of the inks transferred to it in the desired pattern is brought into contact with a suitable conveyor system which typically uses a number of mandrels on a mandrel wheel. The decorator machine is configured so that each can is brought into contact with a blanket so that the full multicoloured indicia is transferred to the surface of the can.

It is inevitable that during a continuous can printing process, some misregistration of one or more of the colours will occur. Traditionally, misregistration problems have been corrected manually. More specifically, any misregistration is detected by manual inspection of the printed cans. If a misregistration is identified, then it has been necessary to shut down printing for a period of time whilst manual adjustments of the inkers are made. This is an inefficient process for at least two reasons. Firstly, there is a time lag before a misregistration is identified which can result in can spoilage. Secondly, it is inefficient and undesirable to shut down a continuous process for any period of time.

SUMMARY

The present invention, in at least some of its embodiments, addresses the above described problems. Additionally, the present invention provides improved arrangements for controlling the position of the print cylinders.

According to a first aspect of the invention there is provided apparatus for printing onto cylindrical structures comprising:

a plurality of inker devices each comprising a print cylinder and one or more servomotors for adjustably controlling the position or orientation of the print cylinder;

a blanket device comprising a plurality of print blankets, in which the blanket device is configured to bring each print blanket into contact with the print cylinders to transfer ink from the print cylinders to the print blanket, and to bring each print blanket into contact with a cylindrical structure to achieve printing thereon;

a transporter for transporting cylindrical structures into and out of contact with the print blanket; and an automatic print correction system comprising a print inspection device for detecting a misregistration of ink transferred from one or more of the print cylinders onto a print blanket, and a controller for controlling the servomotors of the print cylinders to correct the misregistration in response to data received from the print inspection device.

In this way, the above described problems can be solved. In particular, detection of misregistrations can take place quickly. Also, misregistrations can be corrected without stopping the printing process.

The print detection device may inspect the print blankets to detect a misregistration.

Alternatively, the print detection device may inspect the printed cylindrical structures to detect a misregistration. Alternatively still, the print detection device may inspect the print cylinders to detect a misregistration.

The print detection device may comprise a camera. The print detection device may comprise a single camera, or a plurality of cameras.

The print cylinders may each have a longitudinal adjustment servomotor. The longitudinal adjustment servomotor may adjustably control the longitudinal position of its respective print cylinder. The longitudinal adjustment servomotors may be controlled by the controller. The print cylinders may be each connected to their respective longitudinal adjustment servomotor through a print shaft. At least a portion of the print shaft may be movable by the longitudinal adjustment servomotor so as to adjustably control the longitudinal position of its respective print cylinder. The print shafts may each comprise an outer shaft member and an inner shaft member. The inner shaft member may be reciprocable within the outer shaft member. The inner shaft member may be connected to its respective longitudinal adjustment servomotor and print cylinder so that the longitudinal adjustment servomotor can adjust the longitudinal position of the print cylinder by moving the inner shaft member. In practice, commercial decorator apparatus are configured so that the longitudinal direction is in the vertical, and a longitudinal adjustment alters the vertical position of a print cylinder.

The print cylinders may each have an angular adjustment servomotor. The angular adjustment servomotors may adjustably control the angular orientation of their respective print cylinders about a rotational axis. The angular adjustment servomotors may be controlled by the controller.

The apparatus may further comprise a drive mechanism. The print cylinders may each be connected to a print shaft which carries a gear, the gear being driven by the drive mechanism to cause the print cylinder to rotate about the rotational axis. The angular adjustment servomotor may be arranged to alter the operation of the gear so as to adjustably control the angular orientation of its respective print cylinder. The gear may be a backslash gear. The backslash gear carries gear teeth which may be inclined at an angle with respect to the longitudinal axis of the print shaft. The angular adjustment servomotor may adjust the longitudinal position of the backslash gear which in turn results a rotational adjustment of the print cylinder about its rotational axis. In this way, the angular orientation of the print cylinder can be controlled.

The gear may be slideable along the print shaft under the control of angular adjustment servomotor. Each angular adjustment servomotor may be connected to one or more cam followers which follow a cam. The cam may be disposed on the print shaft and form part of or be connected to a hub. A hub may be slideable along the print shaft. The gear may be mounted on the hub. In practice, the rotational axis corresponds to the longitudinal axis of the print cylinder. Commercial decorator apparatus are configured so that the rotational axis is a vertical axis.

The apparatus may print onto cans. The transporter may be configured to transport cans into and out of contact with the print blankets. The transporter may comprise a plurality of mandrels for holding the cans. The cans may be metallic cans, such as aluminium, or maybe formed from another material. The cans may be beverage cans.

Typically, the controller comprises a computer or another device or system which utilises a microprocessor. The controller may comprise a graphical interface.

The print cylinder may comprise a main portion and a print plate which may be removeably attached to the main portion. The print plate may be removeably attached to the main portion by magnetic attachment. The print plate may comprise raised features corresponding to a desired print pattern.

Indicia of any desired kind may be printed onto the cans. The indicia may comprise one or more of an image, a design, a logo, or words.

The print cylinder may each print one or more registration indicia onto the print blankets. The print blankets may each comprise one or more corresponding registration features. Misregistration of ink transferred onto a print blanket may be detected by detecting a misregistration between a registration indicia printed by a print cylinder and the corresponding registration feature on a print blanket. The misregistration may be corrected so that a printed registration indicia and its corresponding registration feature overlap, and preferably fully overlap. The registration indicia and registration features may be any convenient shape or symbol. For example, dots, lines or crosses may be used. The registration features may be located towards the edge of the print blankets. The print detection device may be configured to only detect registration indicia and registration features, or at least to monitor only a subset of entire printing field. This can reduce the complexity of the print inspection system.

According to a second aspect of the invention there is provided a method of printing onto cylindrical structures comprising the steps of:

operating a plurality of inker devices to apply ink to a plurality of print cylinders, each inker device having one or more servomotors for adjustable controlling the position or orientation of its print cylinder;

transferring ink from the print cylinders to a print blanket;

transferring ink from the print blanket to a cylindrical structure to achieve printing thereon; and automatically detecting a misregistration of ink transferred from one or more of the print cylinders onto the print blanket and automatically controlling the servomotors of the print cylinders to correct the misregistration in response to the detection of a misregistration.

It is advantageous that both the automatic detection of a misregistration and the automatic control of the servomotors to correct the misregistration can be performed as part of a continuous printing process. In other words, the process does not have to be stopped in order for the misregistration to be corrected.

According to a third aspect of the invention there is provided apparatus for printing onto cylindrical structures comprising:

a plurality of inker devices each comprising a print cylinder, a print shaft connected to the print cylinder, and a servomotor for adjustably controlling the position of the print cylinder;

a blanket device comprising a plurality of print blankets, in which the blanket device is configured to bring each print blanket into contact with the print cylinders to transfer ink from the print cylinders to the print blanket, and to bring each print blanket into contact with a cylindrical structure to achieve printing thereon; and a transporter for transporting a cylindrical structure into and out of contact with the print blanket;

in which, in each inker device, the print shaft comprises an outer shaft member and an inner shaft member which is reciprocable within the outer shaft member, and the inner shaft member is connected to the servomotor.

In this way, an extremely convenient and accurate means is provided for adjusting and controlling the position of the print cylinder. The arrangement is space saving, and permits easy maintenance. Additionally, it is convenient to provide a retrofit to an existing decorator apparatus. The third aspect of the invention can be conveniently incorporated into decorators of the Rutherford type. However, the invention is not limited in this regard, and this aspect of the invention can be incorporated into other decorator designs.

Whilst the invention has been described above, it extends to any inventive combination of the features set out above, or in the following description, drawings or claims. For example, any feature described in relation to one aspect of the invention is considered to be disclosed also in relation to another aspect of the invention.

BRIEF DESCRIPTION OF THE DRAWINGS

Embodiments of apparatus and methods in accordance with the invention will now described with reference to the accompanying drawings, in which:—

DETAILED DESCRIPTION OF THE EMBODIMENTS

Figure 1:
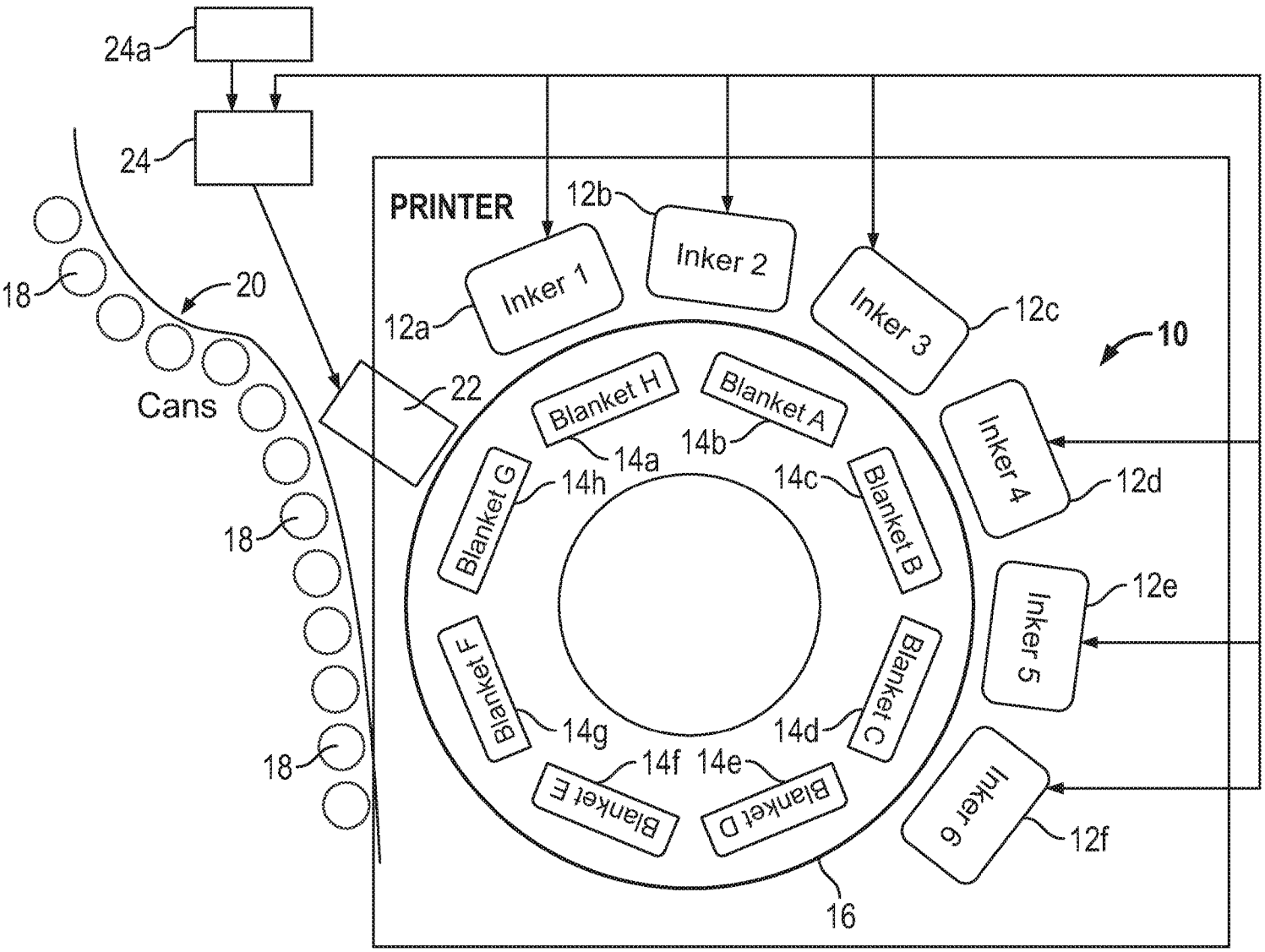
FIG. 1 is a plan view of a decorator apparatus of the invention.

FIG. 1 shows a decorator apparatus of the invention, depicted generally at 10. The decorator apparatus 10 comprises a plurality of inkers 12*a*, 12*b*, 12*c*, 12*d*, 12*e*, 12*f* and plurality of blankets 14*a*, 14*b*, 14*c*, 14*d*, 14*e*, 14*f*, 14*g*, 14*h*. The blankets are disposed on a blanket wheel 16. The blanket wheel 16 rotates so as to bring the blankets into contact with the inkers to transfer ink onto the blankets. The rotation of the blanket wheel 16 also brings each blanket into contact with a can 18 so as to transfer the ink onto the surface of the can. The cans 18 are transported into and out of contact with the blankets by a conveyor system 20. In the embodiment shown in FIG. 1, there are six inkers 12 which enables up to six different colour inks to be used to form the complete indicia which is printed onto the cans 18. Also in the embodiment shown in FIG. 1, the decorator apparatus 10 comprises eight blankets 14. It will be appreciated that the invention is not limited in this regard, and in principle any suitable numbers of inkers and blankets might be utilised.

The design and operation of the blankets, blanket wheel and conveyor can be essentially conventional in nature. Therefore, it is not necessary to provide a further, more detailed discussion of these portions of the decorator apparatus 10. The inkers comprise a print cylinder which is rotated by a print shaft. These aspects of the inkers and described in more detail below. Other features of the inkers, such as the arrangement for applying ink to the print cylinders, are essentially conventional in nature. Therefore, a more detailed discussion of those portions of the inkers is not necessary. The decorator apparatus 10 further comprises a camera 22 and a controller device 24.

Figure 2A:
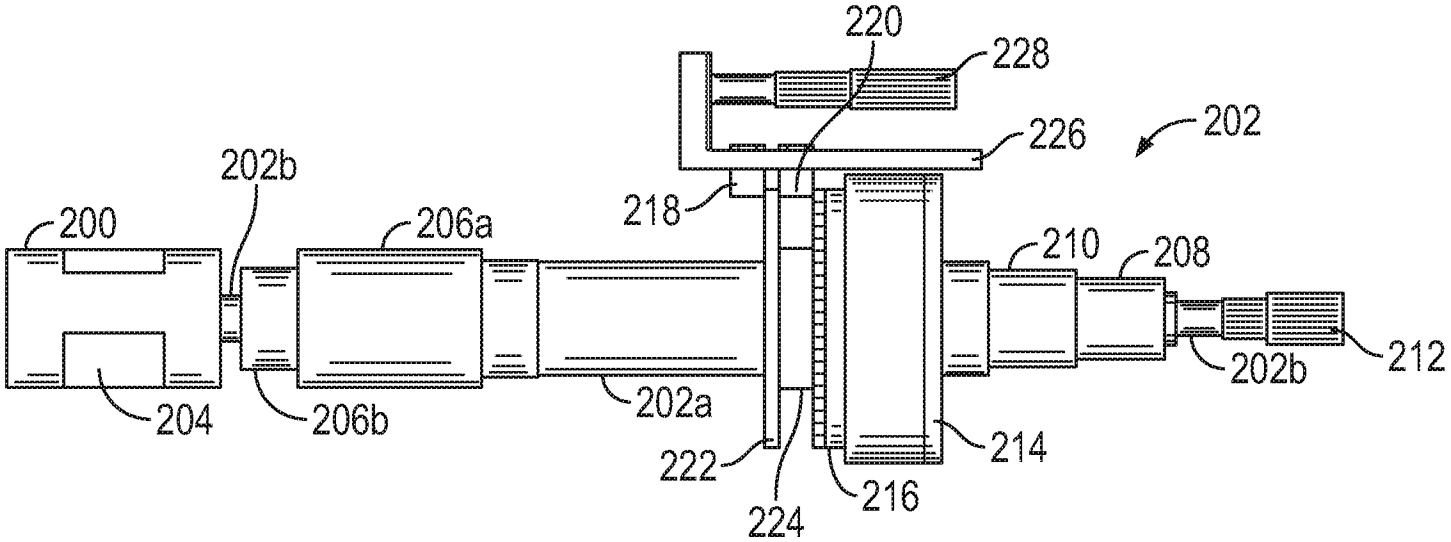
FIG. 2 shows (a) a side view and (b) a cross sectional side view of a print cylinder and print shaft of the invention.
Figure 2B:
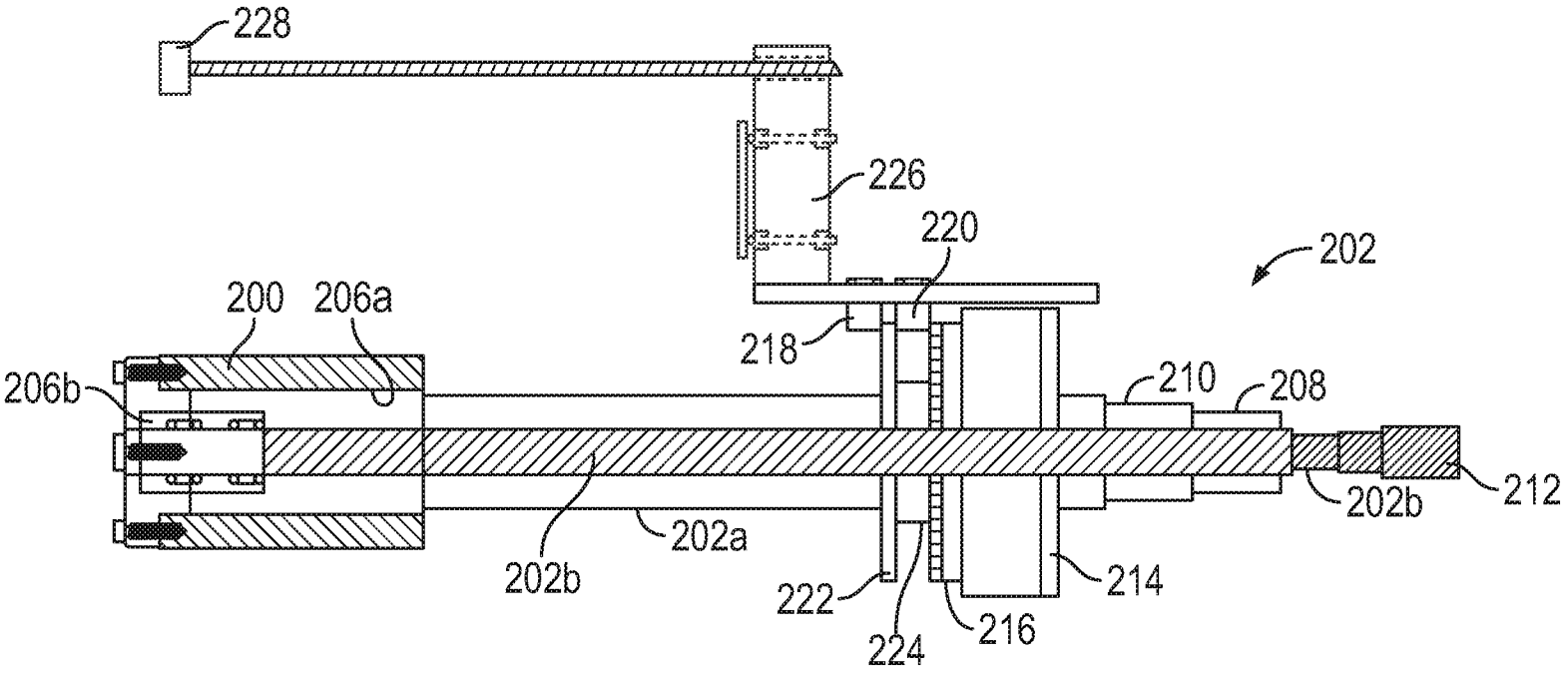

FIG. 2 shows the printer cylinder 200 and print shaft 202 of the inkers 12. The print cylinder 200 has a print plate 204 disposed thereon. The print cylinder 200 is magnetic and the print plate 204 is formed from a metal so that the print plate 204 is retained in place. The print plate 204 has raised features which correspond to the print pattern for the ink colour which is applied by the particular inker which the print cylinder 200 is associated with. The print shaft 202 comprises an outer print shaft 202*a* and an inner print shaft 202*b*. The outer print shaft 202*b* has a print cylinder contacting portions 206*a*, 206*b* formed towards one end of the print shaft 202. The print cylinder contacting portion 206*a* can be in the form of a cylinder of larger diameter than the diameter of the outer print shaft 202*a*. Towards the end of the print shaft which is opposite to the end having the print cylinder contacting portion 206*a*, the outer print shaft 202*a* comprises bearing seats 208, 210. The bearing seats 208, 210 house bearings (not shown) which surround the inner print shaft 202*b*.

The end of the inner print shaft 202*b* distal from the print cylinder 200 is connected to a first servomotor 212. The first servomotor 212 is a linear servomotor, and in this way it is possible to adjust the longitudinal position of the inner print shaft 202*b*. As shown in FIG. 2(*b*), the other end of the inner print shaft 202*b* is connected to the print cylinder 200. The print cylinder 200 is sized so as to be slideable over the surface of the print cylinder contacting portion 206*a*. It will be appreciated by the skilled reader that, in this way, the first servomotor 212 is able to adjust the longitudinal position of the print cylinder 200. The longitudinal axis corresponds to the rotational axis of the print cylinder, and in practice it is longitudinal. The print cylinder contacting portion 206*b* also contacts part of the print cylinder 200.

The print shaft further comprises a backslash gear 214 which is carried by a hub 216. The backslash gear 214 is driven by a bull gear (not shown) which forms part of a conventional decorator apparatus drive mechanism. Cam followers 218, 220 follow a cam 222. The cam 222 is connected to the hub 216 by a connection member 224. The hub 216 is able to move longitudinally along the outer print shaft 202*a*. A key (not shown) underneath the hub 216 permits this longitudinal movement with respect to the outer print shaft 202*a*. The cam followers 218, 220 are mounted on a mounting piece 226. The mounting piece 226 is connected to a second servomotor 228. The second servomotor 228 is a linear servomotor. The second servomotor 228 can be controlled so as to move the mounting piece 226 which in turn moves the cam followers 218, 220. It will be appreciated that the effect of this controlled movement is to adjust the longitudinal position of the hub 216 with respect to the outer print shaft 202*a*. This also adjusts the longitudinal position of the backslash gear 214. The backslash gear 214 carries gear teeth which are inclined at an angle with respect to the longitudinal axis of the print shaft 202. It will be appreciated that longitudinal adjustment of the position of the backslash gear 216 thereby results in a rotational adjustment of the print cylinder 200. In this way, the angular orientation of the print cylinder 200 can be controlled.

Referring back to FIG. 1, the camera 22 is positioned to monitor the blankets 14 after ink has been transferred to them from the inkers 12 but before printing onto the cans 18 takes place. The camera is used to detect any misregistration of one of more of the differently coloured inks which are applied to the blankets. Images obtained by the camera 22, or related data, are input to a controller device 24. A plurality of cameras may be used instead of a single camera, and this can enable better 3 dimensional images to be obtained. The controller device 24 has a graphical interface 24*a* which in one possible mode of operation enables a user to make corrections manually. However, in another mode of operation the invention provides an automatic correction of any misregistration of the inks applied by one of more of the inkers 12. The controller device 24 utilises a suitable computer program which examines the images obtained by the camera 22, and recognises any misregistration. The controller device 24 and its computer program is also adapted to provide suitable control signals to one or both of the first and the second servomotors of an inker 12 in order to correct the detected misregistration. For example, if a misregistration was detected and it was identified that the cause was that the image applied to the blanket by inker 12*a* was too high, then the longitudinal position of the print cylinder used in inker 12*a* would be lowered in order to correct this misregistration. This would be done by controlling the first servomotor associated with print cylinder of inker 12*a* so as to retract the inner print shaft within the outer print shaft. This has the effect of lowering the print cylinder. Another type of misregistration occurs when one of the ink colours is applied too far to the left or right of a blanket. In this instance, the controller device 24 identifies which inker 12 is responsible for the misregistration and controls the second servomotor associated with this inker device to adjust the position of the cam followers with respect to the longitudinal axis of the print shaft. In this way the position of the backslash gear is adjusted to so as to move the print cylinder clockwise or counter clockwise as required. In this way, the angular orientation of the print cylinder is adjusted so as to correct the misregistration. It will appreciated that if the controller device detects that a number of inks are being applied out of register, then appropriate correction of a plurality of inkers will occur. The detection of the misregistrations and the appropriate adjustment of one or more servomotors to correct the misregistration can be performed in a number of ways. For example, look up tables or algorithms might be used. Another alternative is to utilise artificial intelligence.

Although in the arrangement of FIG. 1 the camera 22 monitors the blankets, other variations are possible. For example, the camera may take images of the cans after printing has taken place. Another possibility is for the camera to examine marks on the print plates. In this instance, the print plates may each comprise a suitable registration mark such as a dot, line or cross. The blankets have corresponding registration features. For example, if a blanket receives six different colours from six different inkers, and the print plate of each inker has a dot as a registration mark, the blankets will have six spaced apart dots, one for each colour. Advantageously, the dots may be located in an outer region of the blanket, for example close to the edge. If there is a misregistration in the printing of one of the colours, then this will be visible as a misregistration between a registration mark on a print blanket and the corresponding mark printed b the relevant print plate. This can be readily detected and appropriate correction may by adjusting the longitudinal position and/or the angular orientation of the relevant print cylinder.

Figure 3:
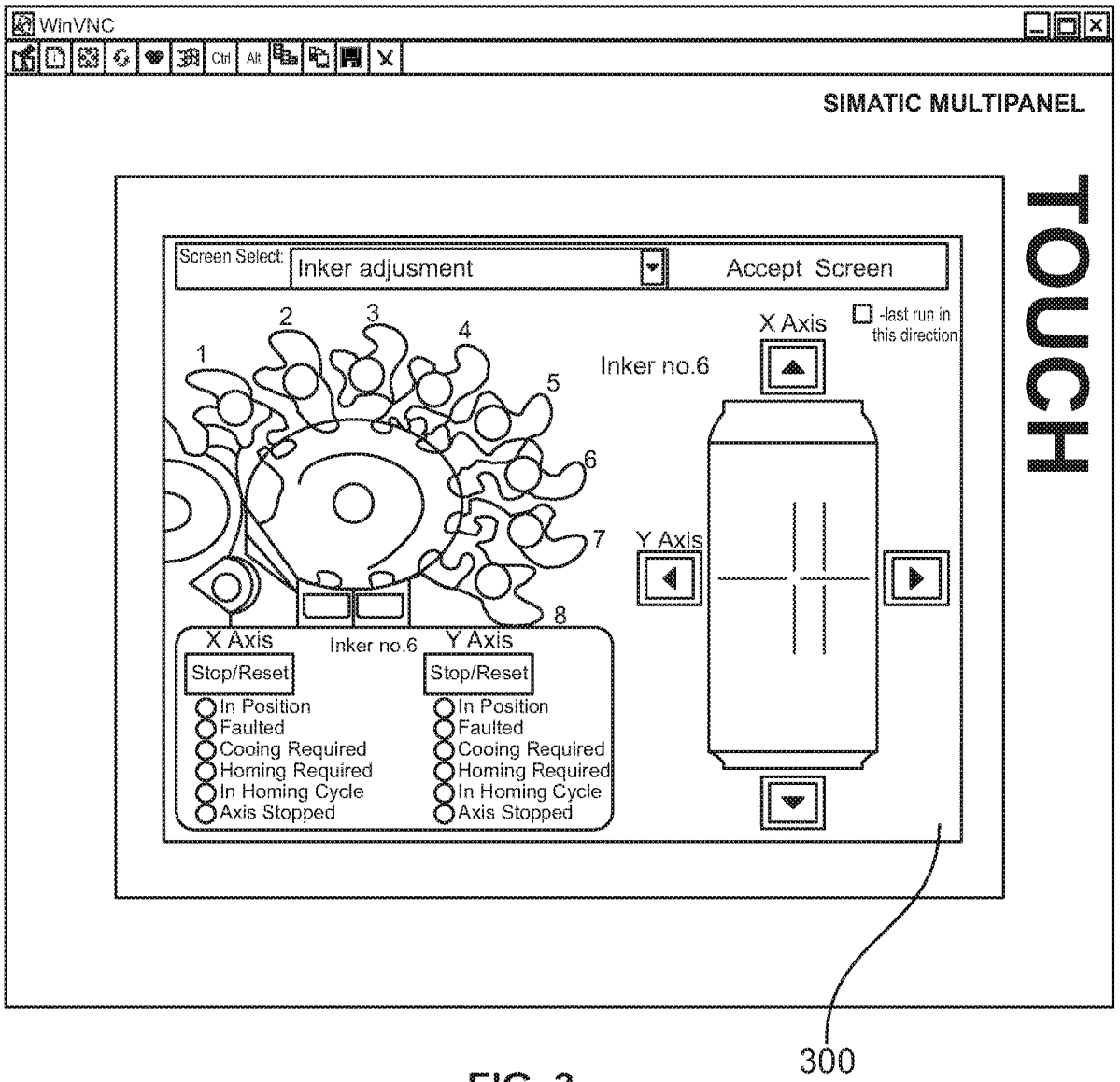
FIG. 3 shows a graphical interface for use by a user.

FIG. 3 shows a graphical interface 300 which might be used in conjunction with the invention. The graphical interface 300 is in the form of a touch screen. The touch screen can be used in a manual adjustment mode, where adjustments to the registration are made by a user. The adjustments made by the user result in appropriate control of the servomotors of one or more of the inkers.

The correction of misregistration provided by the invention has numerous advantages. It is possible to quickly correct misregistration without stopping the decorator apparatus. Rapid detection of any misregistration reduces spoilage caused by misprinting onto cans. If the camera is set up so as to detect misregistration on the blankets (or the print cylinders) then it is possible to detect misregistrations without any spoilage, because misregistration can be detected without printing on the cans. This mode might be employed as part of start up routine, or to make spot checks on registration as part of a manual correction mode.

Other forms of servomotor control of the print cylinder can be used. For example, the actuator system disclosed in U.S. Pat. No. 5,235,911, the entire contents of which are herein incorporated by reference, might be used or adapted for use as part of the misregistration correction methodology provided by the invention. However, it is believed that the servomotor control system described in relation to FIGS. 1 and 2 provides numerous advantages. It is particularly applicable to decorators of the Rutherford type, and in fact it can be retrofitted to existing Rutherford inkers quite easily. The inner print shaft can be provided by drilling a hole through the centre of a standard Rutherford print shaft, and inserting the inner print shaft. This servomotor has a low number of wear parts, and it is space efficient. All of the adjustment components are internal to the inker cylinder, which makes maintenance easier. Also, if it is necessary to remove an inker for maintenance purposes, then it is possible to continue printing onto cans using the inkers. Runs can be made either using one colour fewer, or a substitute inker could be inserted. In this way, maintenance can be performed without having to stop operation of the decorator apparatus.

The invention claimed is:

1. An apparatus for printing onto cylindrical structures comprising:

a plurality of inker devices each comprising a print cylinder and one or more servomotors for adjustably controlling the position or orientation of the print cylinder;

a blanket device comprising a plurality of print blankets, in which the blanket device is configured to bring each print blanket into contact with the print cylinders to transfer ink from the print cylinders to the print blanket, and to bring each print blanket into contact with a cylindrical structure to achieve printing thereon;

a transporter for transporting the cylindrical structures into and out of contact with the print blankets;

a camera positioned to capture an image of a print blanket in the plurality of print blankets; and an automatic print correction system responsive to the image of the print blanket captured by the camera, the automatic print correction system comprising a print inspection device for detecting a misregistration of ink transferred from one or more of the print cylinders onto a print blanket, and a controller for controlling the servomotors of the print cylinders to correct the misregistration in response to data received from the print inspection device.

2. The apparatus according to claim 1 in which the print inspection device inspects the print blankets to detect a misregistration.

3. The apparatus according to claim 1 in which the print inspection device comprises a camera.

4. The apparatus according to claim 1 wherein each print cylinder has a longitudinal adjustment servomotor which adjustably controls a longitudinal position of its respective print cylinder, wherein the longitudinal adjustment servomotors are controlled by the controller.

5. The apparatus according to claim 4 in which the print cylinders are each connected to their respective longitudinal adjustment servomotor through a print shaft, wherein at least a portion of the print shaft is moveable by the longitudinal adjustment servomotor so as to adjustably control the longitudinal position of its respective print cylinder.

6. The apparatus according to claim 5 in which the print shafts each comprise an outer shaft member and an inner shaft member which is reciprocable within the outer shaft member, in which the inner shaft member is connected to its respective longitudinal adjustment servomotor and print cylinder so that the longitudinal adjustment servomotor can adjust the longitudinal position of the print cylinder by moving the inner shaft member.

7. The apparatus according to claim 1 in which the print cylinders each have an angular adjustment servomotor which adjustably controls the angular orientation of its respective print cylinder about a rotational axis, wherein the angular adjustment servomotors are controlled by the controller.

8. The apparatus according to claim 7 further comprising a drive mechanism, in which the print cylinders are each connected to a print shaft which carries a gear, the gear being driven by the drive mechanism to cause the print cylinder to rotate about the rotational axis, wherein the angular adjustment servomotor is arranged to alter the operation of the gear so as to adjustably control the angular orientation of its respective print cylinder.

9. The apparatus according to claim 8 in which each gear is slideable along the print shaft under the control of the angular adjustment servomotor.

10. The apparatus according to claim 9 in which each angular adjustment servomotor is connected to one or more cam followers which follow a cam, where the cam is disposed on the print shaft and forms part of or is connected to a hub which is slideable along the print shaft and on which the gear is mounted.

11. The apparatus according to claim 1 in which the transporter is configured to transport the cylindrical structures into and out of contact with the print blankets.

12. A method of printing onto cylindrical structures comprising the steps of:

operating a plurality of inker devices to apply ink to a plurality of print cylinders, each inker device having one or more servomotors for adjustably controlling the position or orientation of its print cylinder;

transferring ink from a print blanket to a cylindrical structure to achieve printing thereon;

capturing an image of the print blanket; and automatically detecting a misregistration of ink transferred from one or more of the print cylinders onto the print blanket based on the captured image of the print blanket; and automatically controlling the servomotors of the print cylinders to correct the misregistration in response to the detection of the misregistration.

13. An apparatus for printing onto cylindrical structures comprising:

a plurality of inker devices each comprising a print cylinder, a print shaft connected to the print cylinder, and a servomotor for adjustably controlling the position of the print cylinder;

a blanket device comprising a plurality of print blankets, in which the blanket device is configured to bring each print blanket into contact with the print cylinders to transfer ink from the print cylinders to the print blanket, and to bring each print blanket into contact with a cylindrical structure to achieve printing thereon; and a transporter for transporting the cylindrical structures into and out of contact with the print blankets;

in which, in each inker device, the print shaft comprises an outer shaft member and an inner shaft member which is reciprocable within the outer shaft member, and the inner shaft member is connected to the servomotor wherein the servomotor can adjust a longitudinal position of the print cylinder by moving the inner shaft member.

14. The apparatus according to claim 13 wherein the servomotor is responsive to a detected a misregistration of ink transferred from one or more of the print cylinders onto the print blanket based on a captured image of at least one of the plurality of print blankets.

15. An apparatus for printing onto cylindrical structures comprising:

a plurality of inker devices each comprising a print cylinder and one or more servomotors for adjustably controlling the position or orientation of the print cylinder;

a blanket device comprising a plurality of print blankets, in which the blanket device is configured to bring each print blanket into contact with the print cylinders to transfer ink from the print cylinders to the print blanket, and to bring each print blanket into contact with a cylindrical structure to achieve printing thereon;

a transporter for transporting the cylindrical structures into and out of contact with the print blankets;

a camera positioned to capture an image of a print blanket in the plurality of print blankets; and an automatic print correction system responsive to the image of the print blanket captured by the camera, the automatic print correction system comprising a print inspection device for detecting a misregistration of ink transferred from one or more of the print cylinders onto a print blanket, and a controller for controlling the servomotors of the print cylinders to correct the misregistration in response to data received from the print inspection device, wherein, in each inker device, a print shaft comprises an outer shaft member and an inner shaft member which is reciprocable within the outer shaft member, and the inner shaft member is connected to a longitudinal adjustment servomotor of the one or more servomotors, wherein the longitudinal adjustment servomotor can adjust a longitudinal position of the print cylinder by moving the inner shaft member.

* * * * *